United States Patent [19]

Marshall

[11] Patent Number: 4,471,864

[45] Date of Patent: Sep. 18, 1984

[54] SLUG REJECTOR

[76] Inventor: Duane Marshall, 9 Hadley Rd., Lexington, Mass. 02173

[21] Appl. No.: 338,895

[22] Filed: Jan. 12, 1982

Related U.S. Application Data

[63] Continuation of Ser. No. 127,632, Mar. 6, 1980, abandoned.

[51] Int. Cl.[3] ..... G07F 3/02

[52] U.S. Cl. ..... 194/100 A; 73/163

[58] Field of Search ..... 194/97 R, 100 R, 100 A; 73/163

[56] References Cited

U.S. PATENT DOCUMENTS

| | | | |
|---|---|---|---|
| 3,165,706 | 8/1961 | Sarratt | 331/18 |
| 3,599,771 | 8/1971 | Hinterstocker | 194/100 A |
| 3,749,220 | 7/1973 | Tabiichi et al. | 194/100 A |

FOREIGN PATENT DOCUMENTS

| | | | |
|---|---|---|---|
| 2723516 | 12/1978 | Fed. Rep. of Germany | 194/100 A |
| 1575609 | 6/1969 | France . | |

*Primary Examiner*—Joseph J. Rolla

[57] ABSTRACT

A slug rejector in which a coin-testing oscillator provides, when a coin or slug passes through the field of its coil, an output in its linear range which is used to actuate a coin diverting gate. To stabilize the operation of the coin-testing oscillator, a reference oscillator is provided which is continuously in operation. The output of the reference oscillator is used to generate correcting signals which are fed back to the oscillator circuit to maintain its output at a constant amplitude. The same correcting signals are also fed back to the coin-testing oscillator whereby its output for a predetermined coin or slug is a constant repeatable value.

9 Claims, 1 Drawing Figure

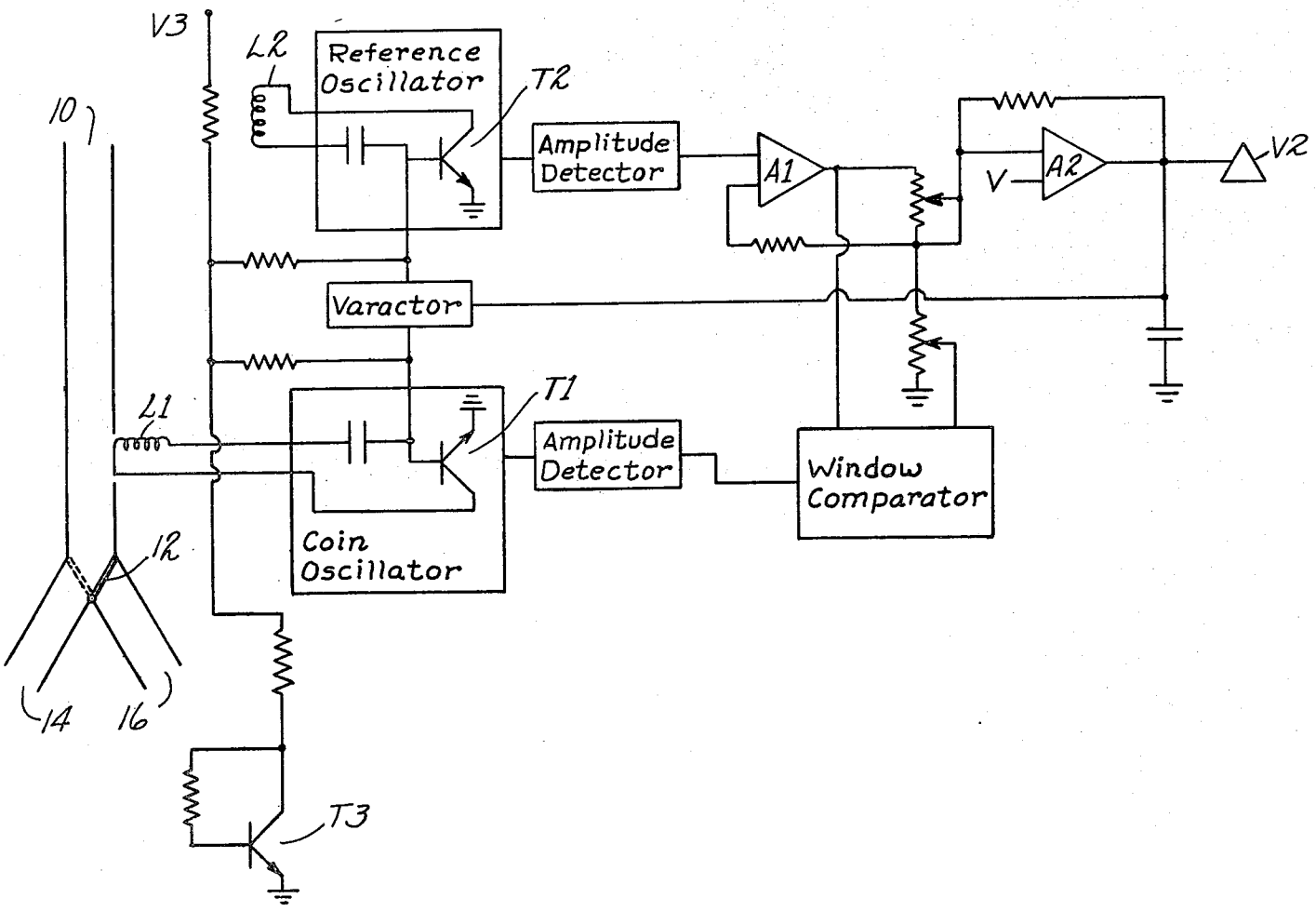
V2
A2
V
A1
Window Comparator
Amplitude Detector
Amplitude Detector
T2
T1
Reference Oscillator
Varactor
Coin Oscillator
T3
L2
V3
L1
12
10
16
14

SLUG REJECTOR

This is a continuation application of Ser. No. 127,632, filed Mar. 6, 1980, now abandoned.

BACKGROUND OF THE INVENTION

There is a continuing need for improved devices for use with coin-operated apparatus such as vending machines, coin changers, telephones, etc., to distinguish genuine U.S. coins from slugs and foreign coins. Various mechanical and electrical devices have been utilized for such purpose; however, none of them successfully rejects all types of slugs or undesirable foreign coins under all conditions.

One type of system that has been proposed is the use of a pair of oscillators in a bridge circuit, with the coil of one oscillator being loaded with a genuine coin. A coin or slug inserted into the machine is made to pass through the field of the coil of the other oscillator, which either balances the bridge or not. If the coin is genuine, the bridge is balanced and an output signal, or a lack of an output signal, depending on the associated circuitry, opens a mechanical gate to allow the coin to pass into the coin receptacle and actuate the mechanism. One such device is illustrated in U.S. Pat. No. 3,059,749 to Zinke, issued Oct. 23, 1962.

In a co-pending U.S. patent application Ser. No. 43,713, filed May 30, 1979, now abandoned, by George E. Fafard and assigned to the same assignee as this invention, there is illustrated another method of utilizing an oscillator coil to distinguish between genuine U.S. coins and undesired coins or slugs. In the device shown in that application, the output from the oscillator circuit is applied to a window comparator. If the oscillator output falls within the voltage limits established by the window comparator for genuine coins, an output signal is produced. The voltage limits for the window detector are provided from a conventional voltage source. In that application, the reflecting of the coin is also measured by an LED photocell apparatus, principally to identify lead slugs. Although this device operates satisfactorily in a constant temperature environment, it is not suitable for use in locations where there are substantial temperature changes.

SUMMARY OF THE INVENTION

In accordance with this invention, as in the above-identified application, means is provided for causing a coin to be tested to pass through the field of the coil of an oscillator to provide an output signal, which is fed to a window comparator.

However, in the present invention a second or reference oscillator is provided to stabilize the first oscillator against ambient temperature changes. The reference oscillator, which is in continuous oscillation, is made to have an output voltage equal to a constant reference voltage, and the reference oscillator base is connected to the coin oscillator base by a varactor, and both oscillators are driven by the same constant current source. The output of the reference oscillator is utilized to provide the reference voltages for the window detector.

The parameters of the circuits are such that the coin oscillator does not oscillate unless a coin or slug is present in the field of the coil, and is so adjusted that a genuine U.S. coin causes oscillation to occur at a low amplitude, since all slugs (except steel) cause a higher amplitude of oscillation than genuine U.S. coins, the difference in response between genuine coins and slugs is maximized. Means is also provided for minimizing the effect of ambient temperature on the system.

The reference oscillator and the coin oscillator are identical in construction, and operate at a frequency of about 3 megahertz so that the coin oscillator is affected only by the surface composition of the coin.

BRIEF DESCRIPTION OF THE DRAWING

FIG. 1 is a block diagram of an electrical circuit embodying the features of the invention.

DESCRIPTION OF THE ILLLUSTRATED EMBODIMENT

Referring to the drawing, there is illustrated, in block diagram form, a circuit for use in a coin testing device embodying the invention. The circuit comprises a coin testing oscillator which includes a coil L1 positioned in relation to a coin chute 10, a peak detector receiving the output of the oscillator, and a window comparator receiving the output of the peak detector. The output of the window comparator is fed to a relay K, which operates a mechanical gate 12. The gate 12 is normally in the reject position, whereby the coin falls into a discharge chute 14, and moves to allow a coin to be diverted to chute 16 into vending machine mechanism only when an output signal is received from the window comparator. The output signal from the window comparator occurs only when a coin of the right composition passes the coil L1, providing an output within a predetermined voltage range from the oscillator.

To provide a maximum output voltage difference between the slugs of various compositions and U.S. coins, the coin testing oscillator is designed so that no oscillation occurs when there is no coin or slug in the field of its coil L1, and when a U.S. coin (of the copper-nickel clad type) is in the field of its coil, oscillation occurs at as low a level as possible. As will appear hereinafter, slugs and coins made of other materials, such as foreign coins, provide an oscillator output voltage higher than that of U.S. coins of the clad type. Therefore by maintaining the oscillator output with U.S. coins as low as possible, the output of the undesired coins and slugs occurs above the output of the U.S. coins on a linear portion of the oscillator output curve, thereby insuring maximum voltage separation between genuine coins and slugs.

The above portion of the device is similar to the oscillator detector arrangement shown in the above-identified co-pending patent application. In that circuit, the high and low voltages used as the reference voltages for establishing the limits of the window comparator were taken from the power supply for the apparatus.

In the circuit of this invention, the reference voltages for the window comparator are taken from a reference oscillator which is so associated with the coin oscillator so as to stabilize its operation.

In the circuit illustrated in FIG. 1 the reference oscillator is identical in its circuit and components to the coin oscillator, including its coil L2. The output of the reference oscillator, which is continuously maintained in oscillation during the operation of the device, is fed to a buffer amplifier A1 through a peak detector. The output of the buffer amplifier, suitably adjusted, is utilized to provide the high and low reference voltages for the window comparator.

A reference amplifier A2 is energized by a constant reference voltage V, and, in conjunction with the buffer amplifier, compares the output voltage of the oscillator with the reference voltage. Any difference is amplified by the reference amplifier to provide a control voltage V which is applied to the center top of a varactor F. Each outside terminal of the varactor is connected to the base of one of the transistors (T1 or T2) in an oscillator circuit. When the output of the reference oscillator tends to rise because of a temperature change, the output of the buffer amplifier tends to rise. The output of the reference amplifier decreases, so that the voltage at the center top of the varactor also decreases, causing an increase in the shunt capacity thereof to change the feedback to the oscillator transistor bases and thereby cause a reduced output of both of said oscillators, thereby maintaining a constant voltage output of the reference oscillator. Since it is assumed that the change in temperature will also affect the output of the coin oscillator (with a coin or slug in the field of its coil L1), the increased shunt capacity of the varactor applied to the coin oscillator also maintains its output constant for the particular coin or slug.

To provide a stable bias voltage supply to the oscillator transistors T1 and T2, the voltage for the oscillators may be taken from a voltage supply V3 which is stabilized by a transistor T3 connected as a current mirror, as is well known in the art.

In a typical embodiment of the invention, with a reference oscillator, having an output of 1.02 volts (peak) the following peak voltages are obtained from the coin oscillator:

| | |
|---|---|
| Brass slug | 1.80 |
| Aluminum slug | 1.77 |
| Copper slug | 1.70 |
| Lead slug | 1.38 |
| U.S. dime | 1.330 |
| U.S. quarter | 1.25 |
| U.S. half dollar | 1.25 |
| U.S. dollar | 1.25 |
| Steel slugs | No reading |

The above data illustrates that the most critical voltages are those produced by lead slugs and U.S. dimes since slugs of other metals produce voltage above that of lead, and all other U.S. coins produce voltage less than that produced by a dime. In other words, if an adequate voltage spread can be maintained between lead slugs and dimes, the device will effectively separate all slugs from all U.S. coins. Although steel slugs presumably would have a reading less than U.S. coins, the presence of steel in the coil of L1 prevents oscillation from occurring, so that there is no output from the oscillation.

The above data shows a spread of 50 millivolts between the output of the coin oscillator with a lead slug in the field of the coil and its output with a U.S. dime in its field. Therefore the device can be made to distinguish between all slugs and all U.S. coins of the copper-nickel clad type by setting the high reference voltage of the window comparator at about 1.35 volts, so that only output voltages below that amount will provide an output therefrom to energize a relay K to shift gate G to divert the coin from the reject chute into chute 16 which carries the coin into the operating mechanism of the machine.

Although the spread in voltage between a U.S. dime and a lead slug is only 30 millivolts, the spread between a lead slug and other coins is about 120 millivolts, so the herein-described system is especially adapted for use in devices such as slot machines that accept only a single type of coin, such as quarters, half-dollars, or dollars.

In the illustrated diagram of the circuit, it will be understood that the representation of the oscillators is schematic only, as is the representation of the coil L1 in relation to the coin chute 10. The coil L2 will be in a sheltered location; however, it will be in such proximity to the coil L1 that they will be at substantially the same temperature.

The reference oscillator is constantly in sinusoidal oscillation; however, the coin oscillator does not commence oscillation until a coin or slug is placed in the field of coil L1. The circuit parameters of the coin oscillator are such that when a coin or slug is placed in the field of the coil, the oscillations increase to a predetermined repeatable level, remaining sinusoidal, without saturation.

Since certain changes apparent to one skilled in the art may be made in the herein illustrated embodiment of the invention, it is intended that all matter contained herein be interpreted in an illustrative and not a limiting sense.

I claim:

1. Apparatus for testing for desired coins, comprising coin-sensing oscillator means having predetermined temperature-dependent operating characteristics for sensing coins in proximity to part of the oscillator means and for producing a voltage having an amplitude that varies with the type of coin sensed, reference oscillator means having temperature-dependent operating characteristics like those of the coin-sensing oscillator means and adjusted to produce a voltage having an amplitude independent of the presence of coins, and comparator means for comparing an input thereto having a value dependent upon the voltage amplitude of said coin-sensing oscillator means with a reference input thereto having a value dependent upon the voltage amplitude of said reference oscillator means and for producing an output accordingly.

2. Apparatus in accordance with claim 1, wherein said comparator means has a pair of reference inputs with respective high and low values dependent upon the voltage amplitude of said reference oscillator means.

3. Apparatus in accordance with claim 1, wherein said inputs to said comparator means are provided by a pair of peak amplitude detector means responsive, respectively to the oscillations of said coin-sensing oscillator means and said reference oscillator means.

4. Apparatus in accordance with claim 1, further comprising means responsive to the difference between the voltage amplitude of said reference oscillator means and a constant voltage amplitude for adjusting both of said oscillator means to compensate for temperature-dependent changes in the voltages produced thereby.

5. Apparatus for testing for desired coins while compensating for ambient temperature and other environmental changes in the testing apparatus, having, in combination, a coin-sensing oscillator normally maintained just non-oscillatory such that the presence thereat of certain coins sets the same into oscillation, the amplitudes of such oscillation for desired coins being within predetermined low amplitude limits; a reference oscillator having components substantially identical to those of the coin-sensing oscillator and subject to the same ambient environment thereof and adjusted to oscillate substantially to the degree that the coin-sensing oscillator oscillates in the presence thereat of desired coins; means for deriving low and high reference amplitude limits from the reference oscillator and applying the same to a window comparator for comparison with the amplitudes of oscillation of the coin-sensing oscillator in the presence of coins; means for rejecting undesired coins in response to outputs of the window comparator outside the said amplitude limits coresponding to amplitudes produced by the coin-sensing oscillator in the presence of desired coins; and means for feeding back correcting signals from the reference oscillator to itself and to the coin-sensing oscillator in the event that temperature and similar environmental changes cause the reference oscillator to oscillate outside said limits and simultaneously to stabilize the coin-sensing oscillator in the desired normal non-oscillatory condition despite such changes.

6. Apparatus as claimed in claim 5 and in which peak amplitude detector means are provided between the reference and coin-sensing oscillators and the window comparator.

7. Apparatus as claimed in claim 6 and in which the output of the reference oscillator peak detector means is connected through buffer means to provide low and high reference voltages for said window comparator.

8. Apparatus as claimed in claim 5 and in which the said means for feeding back correcting signals includes voltage-variable impedance means connected with the coin-sensing and reference oscillators.

9. Apparatus as claimed in claim 8 and in which said variable impedance means comprises varactor means.

* * * * *